US005829475A

United States Patent [19]

Acker

[11] Patent Number: 5,829,475

[45] Date of Patent: Nov. 3, 1998

[54] ON-DEMAND ZONE VALVE RECIRCULATION SYSTEM

[75] Inventor: Larry K. Acker, Newport Beach, Calif.

[73] Assignee: ACT Distribution, Inc., Newport Beach, Calif.

[21] Appl. No.: 804,289

[22] Filed: Mar. 3, 1997

[51] Int. Cl.[6] ..... F24H 1/00

[52] U.S. Cl. ..... 137/337; 126/362; 137/563; 417/32

[58] Field of Search ..... 137/337, 563; 126/362; 417/32

[56] References Cited

U.S. PATENT DOCUMENTS

| | | | |
|---|---|---|---|
| 2,402,280 | 6/1946 | Green | 137/79 |
| 3,776,261 | 12/1973 | Houghton | 137/337 |
| 4,606,325 | 8/1986 | Lujan, Jr. | 126/362 |
| 4,750,472 | 6/1988 | Fazekas | 126/362 |
| 4,870,986 | 10/1989 | Barrett et al. | 137/119 |
| 4,917,142 | 4/1990 | Laing et al. | 137/563 |
| 4,945,942 | 8/1990 | Lund | 137/563 |
| 5,042,524 | 8/1991 | Lund | 137/337 |
| 5,261,443 | 11/1993 | Walsh | 126/362 |
| 5,277,219 | 1/1994 | Lund | 126/362 |
| 5,323,803 | 6/1994 | Blumenauer | 137/337 |
| 5,351,712 | 10/1994 | Houlihan | 137/337 |
| 5,385,168 | 1/1995 | Lund | 137/337 |
| 5,459,890 | 10/1995 | Jarocki | 126/362 |
| 5,564,462 | 10/1996 | Storch | 137/563 |

*Primary Examiner*—A. Michael Chambers
*Attorney, Agent, or Firm*—Walter A. Hackler

[57] ABSTRACT

A zone valve hot water recirculation system in accordance with the present invention generally includes a hot water source, such as an electric or gas water heater, a conduit for enabling circulation of hot water from hot water source to one or more plumbing fixtures and recovery of water to the hot water source, a pump for accelerating delivery of hot water to the fixtures and, importantly, a zone valve for preventing flow of water into the hot water source during standby periods of the hot water source. A controller, which may include an electronic timer, is provided for causing the zone valve to open and close and the pump to start and stop.

19 Claims, 1 Drawing Sheet

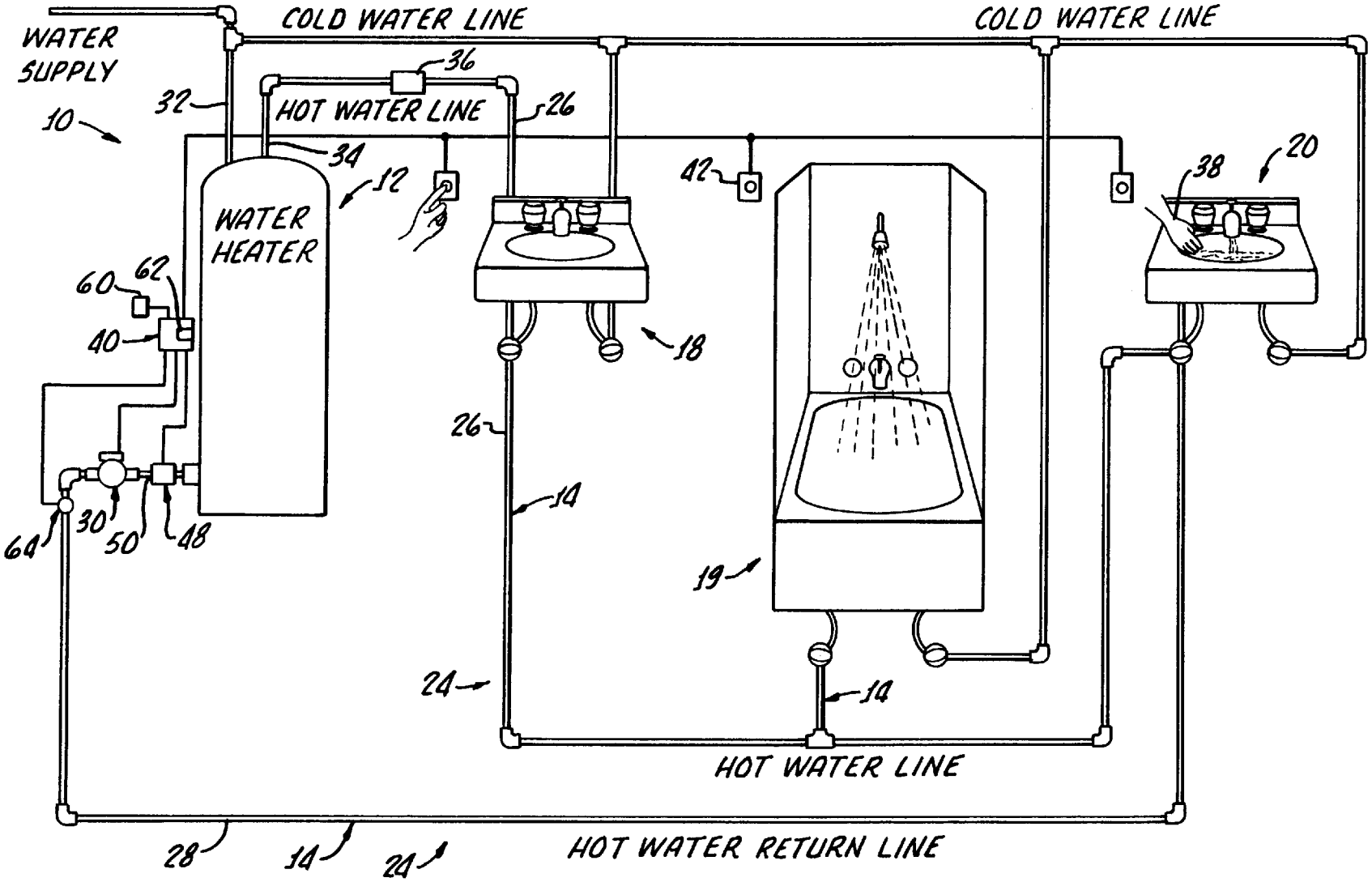
COLD WATER LINE
COLD WATER LINE
HOT WATER LINE
HOT WATER LINE
HOT WATER RETURN LINE
WATER HEATER
WATER SUPPLY
10
12
14
14
14
18
19
20
24
24
26
26
28
30
32
34
36
38
40
42
48
50
60
62
64

ON-DEMAND ZONE VALVE RECIRCULATION SYSTEM

The present invention generally relates to plumbing systems and more specifically relates to a plumbing system having a hot water recirculating line including a zone valve for shutting down the hot water recirculating line during periods of nonuse.

As described in U.S. Pat. Nos. 4,321,943 and 4,798,224, a considerable amount of thermal energy may be wastefully dissipated from hot water lines which provide hot water to plumbing fixtures such as domestic wash basins, dishwashers and clothes washers. In addition, if water is allowed to run down the drain while waiting for hot water to be delivered to the fixtures from a remote hot water source, a substantial water loss may occur.

In order to reduce such water loss, plumbing systems have been devised which continually circulate hot water from a hot water source to the fixture and back to the hot water source. In this arrangement a supply of hot water is always adjacent a plumbing fixture despite the remote position of the hot water source. The water loss is then limited to the amount of cold water disposed in draw pipes interconnecting the plumbing fixture to the hot water conduit in which hot water is circulated.

While this system substantially reduces the amount of water which must be withdrawn from the fixture before suitable hot water is obtained, this type of system is not energy efficient considering the continual loss of heat by thermal radiation out of the surface area of the hot water pipes. In addition, the cost of electrical energy required to operate a continuously running pump contributes to the inefficiency.

Thermal losses in both circulating and noncirculating plumbing systems have been reduced by insulation of the hot water lines as well as the hot water heaters which feed the plumbing fixtures. While such insulation slows the dissipation of heat, no saving over an extended period in noncirculating systems because intermittent use of hot water through the lines still allows hot water to cool to ambient temperatures. In circulating systems of course there is a continual thermal loss during the circulation.

In U.S. Pat. No. 5,042,524, a Demand Hot Water Recovery System is disclosed which circulates hot water from a hot water source to a plumbing fixture upon demand, for example, when a user opens a hot water faucet at the fixture. After a predetermined period of time, or once a certain water temperature is reached near the fixture, the accelerated circulation is stopped, enabling water flow to continue through the hot water supply line by conventional water supply pressure.

U.S. Pat. No. 5,351,712 discloses a hot water recovery system utilizing a flow control system operated by preprogrammed valve functions which systematically alter water flow paths when hot water is demanded by a user.

Devices have been developed which actually recover the hot water remaining in the hot water lines after the use of a fixture by drawing the hot water back into the hot water tank, see for example U.S. Pat. Nos. 4,321,943, 4,798,224 and 5,042,524. Because hot water is removed from the lines, there is an actual reduction in the amount of heat loss rather than just a slowing of heat loss as occurs through the use of insulation alone.

In recirculating systems having a dedicated hot water return line for recovering hot water into the hot water tank, a one-way check valve may be installed in the return line in order to allow water to flow into the hot water heater while preventing flow of hot water out of the hot water heater and back into the return line. During periods of nonuse of a fixture, standing water in the return line may surge into the hot water heater due to normal pressure changes in the plumbing system. When siphoning of water into the hot water tank occurs in such systems, it was generally though to be beneficial as it was believed that it would ease the burden of recovery of water into the tank. Notably, hot water siphoning and recirculating systems, which were designed to promote siphoning of water into the hot water tank in a recirculating system, have been popular in cold climate areas.

Unfortunately, these now conventional recirculating hot water systems may promote energy loss through the use of additional pipes, particularly the hot water return line which allows water to flow from the return line into the hot water heater during periods of nonuse of a plumbing fixture. Normal fluctuations of pressure in the plumbing system may cause surges of cooled standing water to enter the hot water heater well after hot water has been returned to the hot water heater. In addition, the mere contact of standing water in the lines with water in the tank will cause siphoning of heat from the tank, which may contributes to additional heat loss from the water heater, thus automatically causing the hot water heater to turn on in order to raise the water temperature therein. Although hot water recirculating systems have been developed to save energy, the design of many conventional hot water recirculating systems may actually promote some heat loss.

The present invention provides a hot water recirculation system including a positively closing valve, hereinafter referred to as a "zone valve", which prevents any flow of water into, or out of, the hot water tank during stand by periods of the water heater. The present invention saves energy by preventing siphoning from occurring and completely closing the hot water line during periods of nonuse of hot water fixtures. Although the present invention will save a great deal of energy, it is directly opposed to standard procedure for conventional recirculating systems which generally are designed to enable continuous water flow from a return line into the hot water heater.

SUMMARY OF THE INVENTION

Accordingly, a zone valve recirculation system is provided which saves a substantial amount of energy by providing a hot water demand and recovery system including means for positively closing a dedicated hot water return line during periods of nonuse of a plumbing fixture. In effect, the present invention functions to isolate the hot water source from a connecting hot water return line thus preventing siphoning of water into the hot water source.

A hot water recirculation system in accordance with the present invention generally comprises a hot water source, such as a conventional hot water tank, conduit means for enabling circulation of hot water from the hot water source to at least one plumbing fixture and return therefrom, a pump for circulating the hot water through the conduit means, and a zone valve, disposed on the conduit means for preventing a flow of water from the plumbing fixture into the hot water source. Preferably, the conduit means includes a hot water supply line and a separate hot water return line, although alternatively, the hot water supply line may be used as a return line.

The zone valve is normally closed to the flow of water therethrough, thus causing the hot water loop to be noncontinuous, or closed, and the tank to be isolated from contact with any standing water in the hot water pipes.

Preferably, the zone valve is disposed on the hot water return line at a location directly adjacent the hot water tank.

The present invention further comprises switch means for generating a control signal in response to a demand for hot water at the plumbing fixture. Importantly, control means are provided which cause the zone valve to open in response to the control signal, allowing water to flow through the zone valve and thus opening the recirculation loop. After a predetermined time, the zone valve means will return to its closed position, preventing any further flow of water therethrough and conserving heat in the hot water tank.

BRIEF DESCRIPTION OF THE DRAWINGS

The present invention may be more clearly understood with reference to the following detailed description when considered in conjunction with the appended drawing in which:

FIG. 1 shows a diagram of a hot water recirculation system in accordance with the present invention, including conduit means for enabling circulation of hot water from a hot water source to one or more plumbing fixtures, said conduit means including a hot water return line for recovering hot water to a hot water source, and a zone valve, disposed on the hot water return line, which isolates the hot water source from standing water in the return line during nonuse periods of the plumbing fixture.

DETAILED DESCRIPTION

Turning now to the figure, a hot water recirculation system 10 is shown in accordance with the present invention. The system 10 generally comprises a hot water source, for example a conventional water heater 12, such as, for example, a gas, oil, or electric heater, interconnected by means of pipes 14 with plumbing fixtures 18, 19, 20, said pipes providing conduit means for enabling circulation of hot water from said hot water source 12 to each plumbing fixture 18, 19, 20 and return to the hot water source 12. The pipes 14 are thus in fluid communication with the hot water source 12 and the plumbing fixtures 18, 19, 20 in such a way as to establish a hot water loop 24.

More particularly, the pipes 14 may be comprised of a hot water supply line 26 which provides means for transferring hot water from the water heater 12 to each of the fixtures 18, 19, 20, and a separate hot water return line 28 which provides means for enabling recovery of hot water in the pipes 14 and into the water heater 12, after usage of any one of the fixtures 18, 19, 20.

The hot water source 12 may be connected to a cold water source through inlet pipe 32. The hot water source 12 may be heated in any conventional manner. It should be appreciated that the hot water source 12 may be a conventional gas or electric water heater or the apparatus described in U.S. Pat. No. 4,798,224, entitled "Automatic Hot Water Recovery System" or the apparatus described in U.S. Pat. No. 5,042,524, entitled "Demand Recovery System". These patents are incorporated herein by specific reference thereto for the purpose of identifying and describing such hot water recovery apparatus.

A conventional pump 30 is installed in the hot water loop 24 and provides means for circulating hot water through the loop 24.

In addition, a switch 36 provides means for generating a control signal. More particularly, The switch 36 may comprise a flow switch which detects water flow through the pipes 14, for example, when a user opens a hot water valve, such as a faucet 38, on one of the plumbing fixtures 18, 19, 20. In conjunction with the switch 36, control means 40, which may comprise a controller of any conventional mechanical or electrical design, is provided for causing the pump 30 to circulate hot water through the hot water loop 24 in response to the control signal. Thus, as described in U.S. Pat. No. 5,042,524, hot water is not circulated by means of a continuously operating pump, but is pumped to the fixtures upon demand.

The switch may be a flow switch of conventional construction which generates a signal, for example an electrical signal, in response to water flow through the pipe 14. Although the flow switch is shown disposed adjacent the hot water source 12, it may alternatively be disposed beneath any one of the fixtures 18, 19, 20. Alternative to, or in addition to, the flow switch 36, the control signal may be generated by means of a manually activated switch 42 interconnected with the control means 40.

Importantly, a zone valve 48 is provided for preventing any flow of water through the hot water pipes 14. Preferably, the zone valve 48 is disposed, as shown in the Figure, directly between the hot water source 12 and the pump 30 and more preferably, directly adjacent the hot water source.

The zone valve 48 may be of a conventional type of valve which provides complete closure of the pipe 14 at a valve junction 50. The zone valve 48 is preferably comprised of a suitable material and structure that will provide an insulating barrier between water on either side of the valve 48 when the valve 48 is in the closed to flow position, thus minimizing loss of heat from the hot water source 12 into water in the adjacent return line 28. When the zone valve 48 is in the closed position, the hot water source 12 is physically isolated from standing water in the return line 28.

The zone valve 48 is normally closed to a flow of water therethrough. During periods of nonuse of a plumbing fixture 18, the zone valve 48 is in a closed position, thus providing a positive barrier between the hot water source 12 and water in the return line 28.

The control means 40 is interconnected with the switch 36 and the zone valve 48 and provides means for causing the zone valve 48 to and allow water flow therethrough in response to the control signal. Preferably, both the pump 30 and the zone valve 48 will be electronically activated in response to the control signal, such as for example, when a user turns on the hot water faucet 38 at a fixture 18, 19, 20 or otherwise makes a demand of hot water from the plumbing system 10.

As discussed hereinabove, the zone valve 28 is normally in the closed to flow position, isolating the water heater from the return line 28. When the control means 40 receives the control signal generated by either a detection of water flow in the supply line 26 or by manual activation of the manual switch 42, the zone valve 28 will automatically open and the pump 30 will automatically begin to draw water through the hot water loop 24. The pump 30 functions to accelerate drawing of hot water through the loop 24 such that each plumbing fixture 18, 19, 20 will be rapidly supplied with hot water. In addition, the pump 30 forces hot water remaining in the loop 24 to be recovered to the water heater 12 by means of the opened return line 28.

The pump 30 may include an electric motor (not separately shown) and the control means 40 operates to connect and disconnect the pump 30 with a power source 60.

It should be appreciated that once the pump 30 has drawn a sufficient amount of hot water from the water heater 12 to reach the all of the fixtures 18, 19, 20, particularly the fixture most remote from the water heater 12, operation of the pump is no longer necessary. A temperature sensor 62 may be included for causing the pump to stop operation once a selected hot temperature has been sensed in the pipe 14, indicating that the entire loop is now filled with hot water. This intermittent operation of the pump saves energy over a continuously running pump, as described hereinabove.

Importantly, the zone valve 48 will remain open until hot water remaining in the loop has been recovered back into the hot water source 12 after use of a fixture 18, 19,20.

In order to recover as much hot water as possible to the hot water source 12, the zone valve 48 will remain open for a time sufficient to allow water to continue to enter the hot water source after the pump has been stopped.

In order to cause the zone valve 48 to close after a fixture 18, 19, 20 is no longer drawing water and water has been recovered to the hot water source 12, the control means may include timing means 64 for closing the zone valve 48 after selected period of time after water is no longer being drawn through any one of the fixtures. The timing means 64 may be of a conventional design and may be set to cause closing of the zone valve 48 at a predetermined time of the generated control signal. The selected period of time is preferably from between about three to about five minutes.

Alternative to or in addition to the timing means 64, the temperature sensor 62 disposed adjacent the hot water source may provide means for causing the pump 30 to stop and the zone valve 48 to close in response to a temperature variation being detected in the pipe 14.

The control means 40 may be electronically programed to control a sequence of operation of the pump 30 and zone valve 48. For example, when the temperature sensor 62 has detected a temperature increase of between about 1° C. and about 10° C., and most preferably a temperature increase of about 2° C., in the pipe, indicating the entire loop 24 is now filled with hot water, a control signal will be sent to the control means and cause the pump 30 to stop. At this point, the zone valve means 48 will close shortly or immediately thereafter and the system 10 will resume a standby position.

Alternatively, upon a detected temperature increase in the pipe 14, the control means 40 may operate to cause the pump 30 to stop or slow, but the zone valve to remain open such that hot water will continue to flow into the hot water source 12 at a decelerating rate. The temperature sensor 64 will transmit a signal to the control means 40 upon a detected temperature decrease during the time that the zone valve 48 is positioned open to flow. Thus, in this example, the zone valve 48 will allow hot water to continue to flow into the hot water source 12 until a temperature drop has been detected.

In this respect, the temperature sensor 64 may be utilized as means for preventing cooled water from undesirably being recovered into the hot water source 12 by causing the zone valve 48 to close automatically when water being recovered has become cooled by any significant amount. For example, when the temperature sensor 62 has detected a temperature decrease of between about 0.5° C. and about 10° C., indicating that the hot water has been recovered and cooler water has begun to enter the hot water source 12, the control means 40 will cause the zone valve 48 to close, barring further recovery of hot water. This sequence of operation will allow for recovery of a majority of the hot water in the pipes 14 while preventing any cooled water from entering the hot water source 12. Thus, the temperature sensor 62 may thus be used to detect both a selected temperature rise for causing the pump 30 to stop, and selected temperature drop for causing the zone valve 48 to close.

Although there has been hereinabove described a zone valve recirculation system, in accordance with the present invention, for the purpose of illustrating the manner in which the invention may be used to advantage, it will be appreciated that the invention is not limited thereto. Accordingly, any and all modifications, variations, or equivalent arrangements which may occur to those skilled in the art should be considered to be within the scope of the invention as defined in the appended claims.

What is claimed is:

1. A hot water recirculation system comprising:

a hot water source;

conduit means, in fluid communication with the hot water source and at least one plumbing fixture having a hot water valve, for enabling circulation of hot water from said hot water source to the plumbing fixture and return to said hot water source;

pump means for circulating hot water through the conduit means;

zone valve means, disposed on the conduit means, for preventing a flow of water through the conduit means from said hot water source to the plumbing fixture, and for preventing a flow of water from the plumbing fixture to the hot water source;

switch means for generating a control signal; and control means for causing the zone valve means to open and allow water flow there through in response to the control signal.

2. The hot water recirculation system according to claim 1 wherein the control means includes timing means for causing the zone valve means to close after a predetermined time period after use of the fixture.

3. The hot water recirculation system according to claim 2 wherein the predetermined time period is between about three and about five minutes.

4. The hot water recirculation system according to claim 1 further comprising temperature sensor means for causing the zone valve means to close when a water in the conduit means reaches a selected temperature variation.

5. The hot water recirculation system according to claim 4 wherein the selected temperature variation is a temperature increase of between about 1° C. and about 10° C.

6. The hot water recirculation system according to claim 4 wherein the selected temperature variation is a temperature increase of about 2° C.

7. The hot water recirculation system according to claim 4 wherein the selected temperature variation is a temperature decrease of between about 0.5° C. and about 10° C.

8. The hot water recirculation system according to claim 4 wherein the selected temperature variation is a temperature increase of about 2° C.

9. The hot water recirculation system according to claim 1 further comprising temperature sensor means, disposed on the conduit means, for causing the pump to stop in response to a selected temperature increase in water being recovered to the hot water source, and for causing the valve to close in response to a selected temperature decrease in water being recovered to the hot water source.

10. The hot water recirculation system according to claim 9 wherein the selected temperature increase is between about 1° C. and about 10° C., and the selected temperature decrease is between about 0.5° C. and about 10° C.

11. A hot water recirculation system comprising a hot water source;

conduit means for enabling circulation of hot water from the hot water source to at least one plumbing fixture and to enable return of hot water to the hot water source, said conduit means including hot water supply line means for enabling circulation of hot water from the hot water source to the plumbing fixture, and hot water return line means for enabling return of hot water from the fixture to the hot water source;

pump means for circulating hot water through the conduit means;

zone valve means, disposed on the conduit means, for preventing heating of water in the return line means and for preventing siphoning of water into the hot water source during periods of nonuse of the plumbing fixture;

switch means for generating a control signal in response to a draw of water from the hot water valve on said plumbing fixture; and control means for causing the zone valve means to open and allow water flow there through in response to the control signal.

12. The hot water recirculation system according to claim 11 wherein the zone valve means is disposed on the hot water return line means.

13. The hot water recirculation system according to claim 12 wherein the control means includes timing means for causing the zone valve means to open for a predetermined time after use of the fixture.

14. The hot water recirculation system according to claim 13 wherein the predetermined time period is between about three and about five minutes.

15. The hot water recirculation system according to claim 11 further comprising temperature sensor means for causing the zone valve means to close when a water in the hot water return line means reaches a selected temperature variation.

16. The hot water recirculation system according to claim 15 wherein the selected temperature variation is a temperature increase of between about 1° C. and about 10° C.

17. The hot water recirculation system according to claim 15 wherein the selected temperature variation is a temperature decrease of between about 0.5° C. and about 10° C.

18. The hot water recirculation system according to claim 11 further comprising temperature sensor means, disposed on the conduit means, for causing the pump to stop in response to a selected temperature increase in water being recovered to the hot water source, and for causing the valve to close in response to a selected temperature decrease in water being recovered to the hot water source.

19. The hot water recirculation system according to claim 18 wherein the selected temperature increase is between about 1° C. and about 10° C., and the selected temperature decrease is between about 0.5° C. and about 10° C.

* * * * *